US011077025B1

(12) United States Patent
Armstead

(10) Patent No.: US 11,077,025 B1
(45) Date of Patent: Aug. 3, 2021

(54) MEDICATION DISPENSER

(71) Applicant: Scotty Armstead, Pensacola, FL (US)

(72) Inventor: Scotty Armstead, Pensacola, FL (US)

( * ) Notice: Subject to any disclaimer, the term of this patent is extended or adjusted under 35 U.S.C. 154(b) by 0 days.

(21) Appl. No.: 16/677,346

(22) Filed: Nov. 7, 2019

(51) Int. Cl.
*A61J 7/00* (2006.01)
*A61J 1/03* (2006.01)

(52) U.S. Cl.
CPC ..... *A61J 7/0076* (2013.01); *A61J 1/035* (2013.01); *A61J 7/0069* (2013.01); *A61J 2205/00* (2013.01); *A61J 2205/10* (2013.01)

(58) Field of Classification Search
CPC . B01L 7/02; G01N 2035/00435; G01N 35/04
See application file for complete search history.

(56) References Cited

U.S. PATENT DOCUMENTS 4,498,603 A * 2/1985 Wittenborg ..... G07F 11/54 221/120
5,011,042 A * 4/1991 Bunce ..... G07F 9/105 219/700
5,067,630 A * 11/1991 Nesser ..... G07F 11/54 221/76
7,854,332 B1 12/2010 Clausen
8,249,743 B2 8/2012 Pelletier
8,700,212 B1 * 4/2014 Bruno ..... A61J 7/0069 700/242
8,905,944 B2 12/2014 Vaillancourt et al.
2004/0172163 A1 9/2004 Varis
2007/0078562 A1 4/2007 Park, IV
2012/0283867 A1 * 11/2012 Gelbman ..... G01N 35/04 700/215

* cited by examiner

*Primary Examiner* — Gene O Crawford
*Assistant Examiner* — Ayodeji T Ojofeitimi
(74) *Attorney, Agent, or Firm* — John R. Casperson

(57) ABSTRACT

Disclosed is an apparatus useful for securely storing and dispensing medications. The apparatus comprises a cabinet, a carousel mounted in the cabinet, and medication trays carried by the carousel. The carousel comprises a plurality of vertically spaced shelves. Each shelf carries a plurality of radially extending dividers dividing the carousel into a plurality of compartments. The compartments are carried by the carousel into close alignment with a vertical slot in a cabinet wall. Each medication tray is sized and shaped to slide radially in and out of a compartment. Each tray has a base and side walls extending upwardly from the periphery of the base to define a peripherally enclosed area to hold medication doses. Fixtures are mounted in the peripherally enclosed area to vertically position card-blister packaged unit medication doses in multiples of five for visual inventory without manual manipulation of the doses, once a tray is removed from a compartment.

20 Claims, 6 Drawing Sheets

MEDICATION DISPENSER

FIELD OF THE INVENTION

In one aspect, this invention relates to a medication dispensing apparatus. In another aspect, this invention relates to a medication tray that can used in the medication dispensing apparatus.

BACKGROUND OF THE INVENTION

Inpatient care facilities such as hospitals, nursing homes, rehab facilities, prison infirmary, and domicile homes have need to provide individual medication doses to their residents. In even a medium sized facility, the manpower requirements to order, track and inventory and dispense medications to the residents can be quite high. Also, some of the medications are valuable and/or pilferable and need to be secured.

A device to control access to medications, track usage, and provide safety checks would be very desirable.

A device to facilitate inventory of medications would also be desirable.

OBJECTS OF THE INVENTION

It is an object of this invention to provide a device that limits access to one medication at a time.

It is another object of this invention to provide a device that tracks usage of medications.

It is another object of this invention to provide a device that checks bar codes of medications being dispensed.

It is another object of this invention to provide a device that facilitates conducing inventories of medications on hand.

SUMMARY OF THE INVENTION

One embodiment of the invention provides a medication tray that hold card-blister packaged medications in groups of five for rapid inventory. The medication tray comprises a base, side walls extending upwardly from the periphery of the base to define a peripherally enclosed area, and fixtures mounted in the peripherally enclosed area to vertically position card-blister packaged unit medication doses in multiples of five for visual inventory without manual manipulation of the doses.

Another embodiment of the invention provides an apparatus useful for securely storing and dispensing medications. The apparatus comprises a cabinet, a carousel mounted in the cabinet, and medication trays carried by the carousel. The cabinet has top, bottom and lateral walls carried on a frame. One of the lateral walls defines a vertical slot. The carousel is mounted on the frame in the cabinet for rotation about a vertical axis. The carousel comprises a plurality of vertically spaced shelves. Each shelf carries a plurality of radially extending dividers dividing the carousel into a plurality of compartments. The compartments are carried by the carousel into close alignment with the vertical slot. The medication trays are positioned in at least a portion of the compartments. Each medication tray is sized and shaped to slide radially in and out of a compartment. Each tray has a base and side walls extending upwardly from the periphery of the base to define a peripherally enclosed area to hold medication doses. Fixtures are mounted in the peripherally enclosed area to vertically position card-blister packaged unit medication doses in multiples of five for visual inventory without manual manipulation of the doses, once a tray is removed from a compartment.

DETAILED DESCRIPTION OF THE INVENTION

Figure 1:
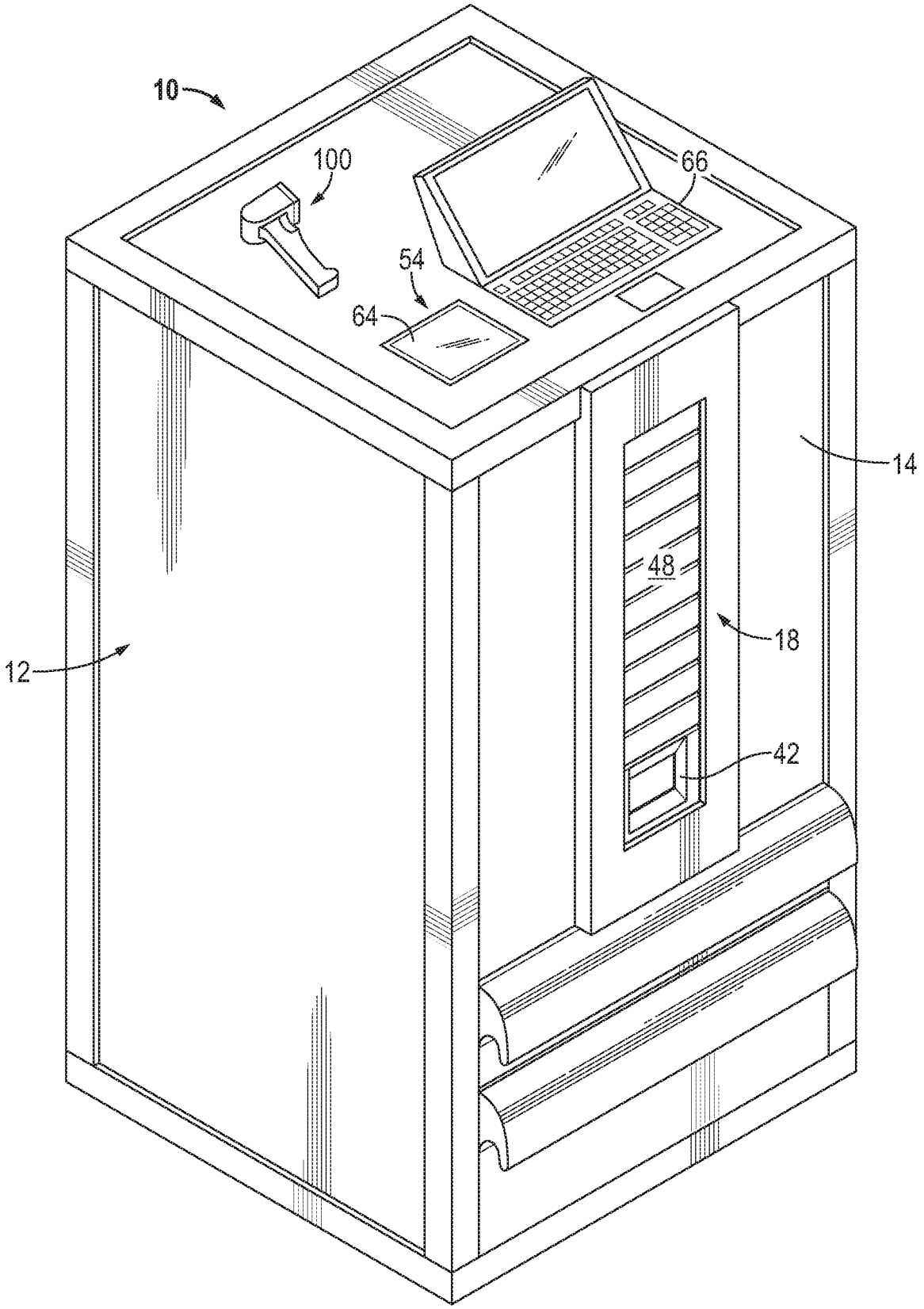
FIG. 1 is a pictorial representation of an embodiment of the invention.
Figure 2:
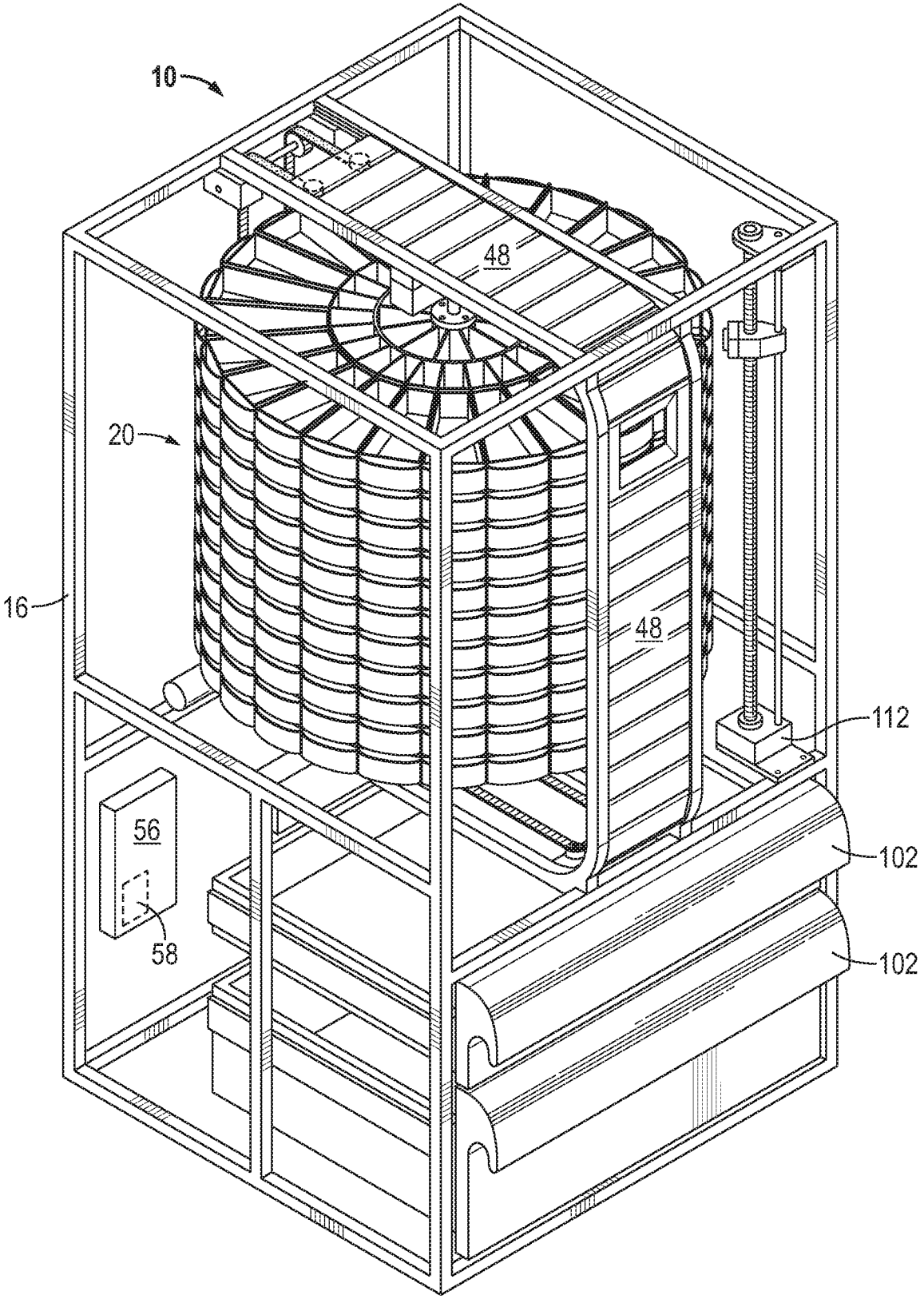
FIG. 2 is a pictorial representation of the invention as in FIG. 1 with housing panels removed to show internal details.
Figure 3:
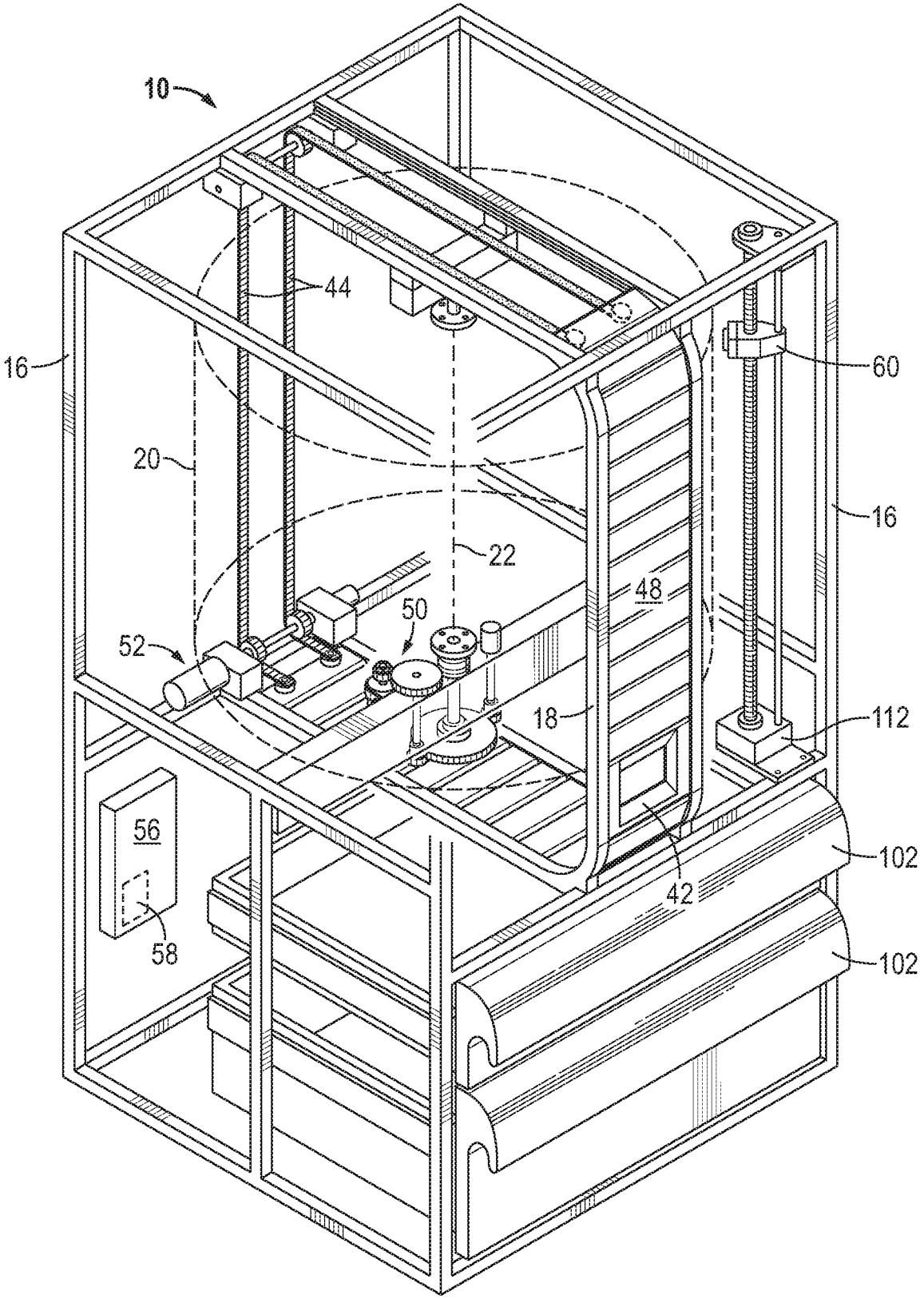
FIG. 3 is a pictorial representation of the invention as in FIG. 2 with an additional element shown in ghost to reveal further internal details.
Figure 4:
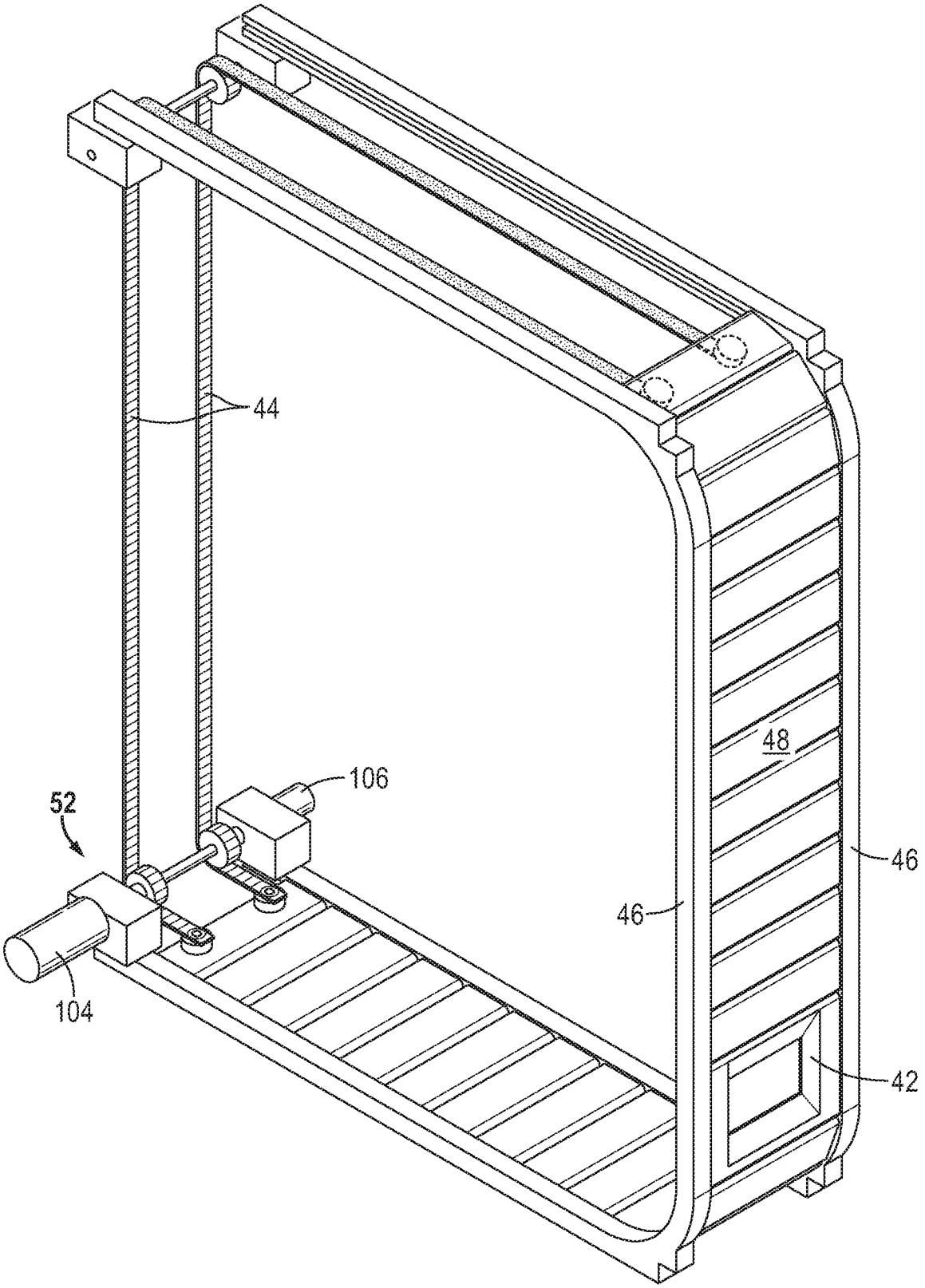
FIG. 4 is a pictorial representation of an element of the invention shown in FIG. 3 revealing further details.
Figure 5:
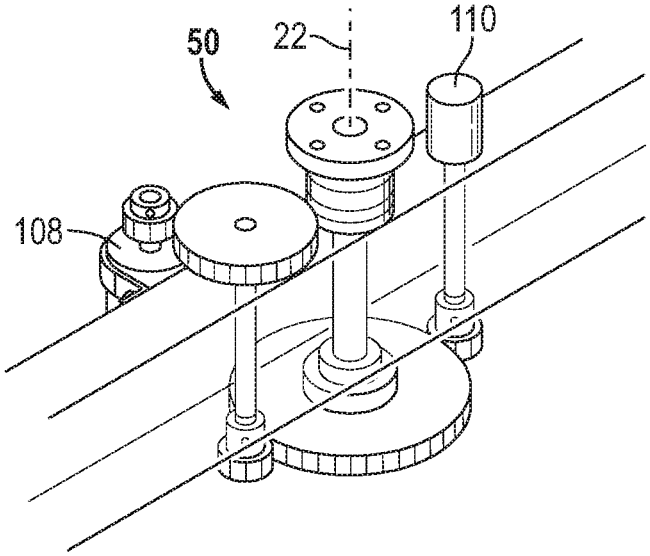
FIG. 5 is a pictorial representation of a broken-out portion of the invention shown in FIG. 3 revealing further details.
Figure 6:
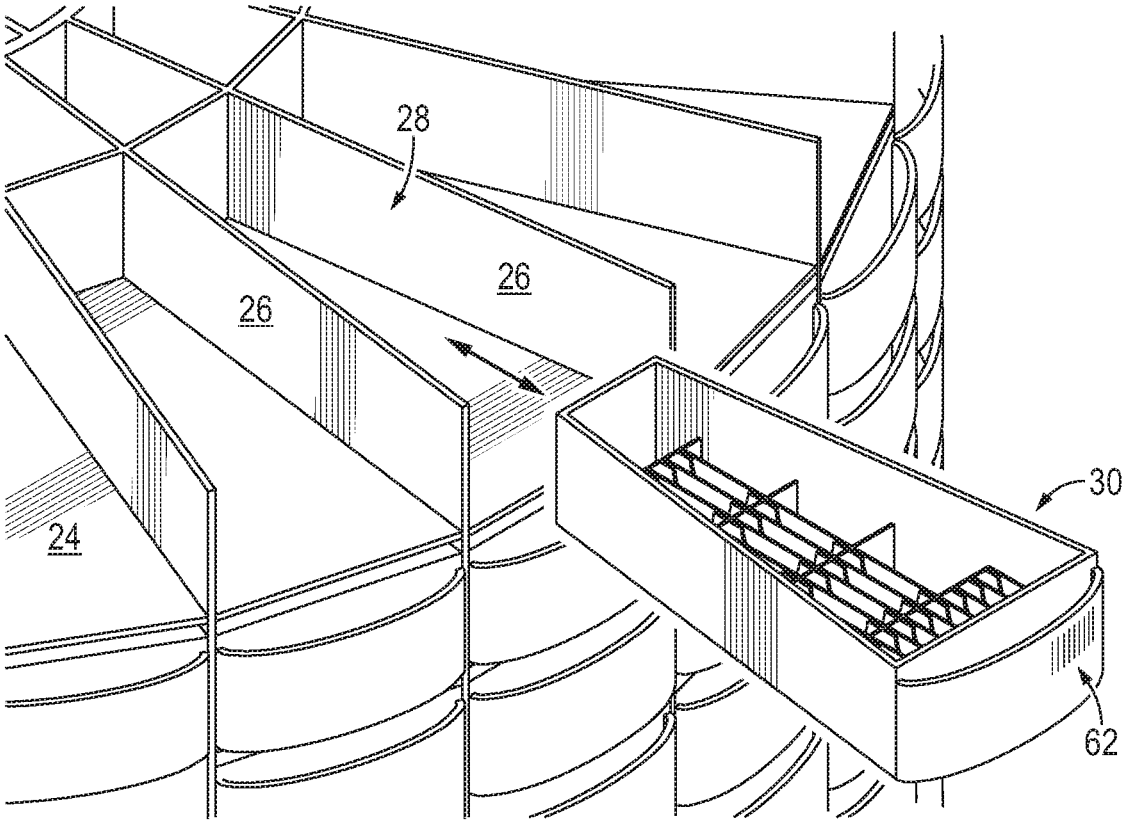
FIG. 6 is an exploded pictorial representation of a portion of the invention shown in FIG. 2 revealing additional details.
Figure 7:
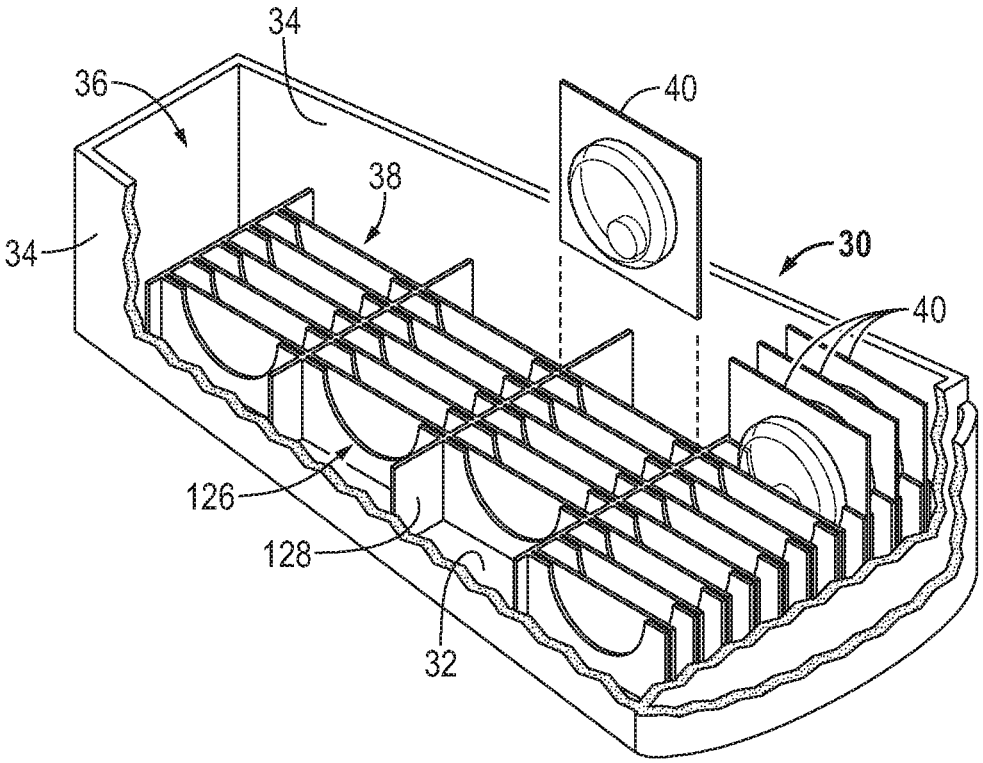
FIG. 7 is a pictorial representation of a portion of the invention shown in FIG. 7 with portions broken away to show additional details.
Figure 8:
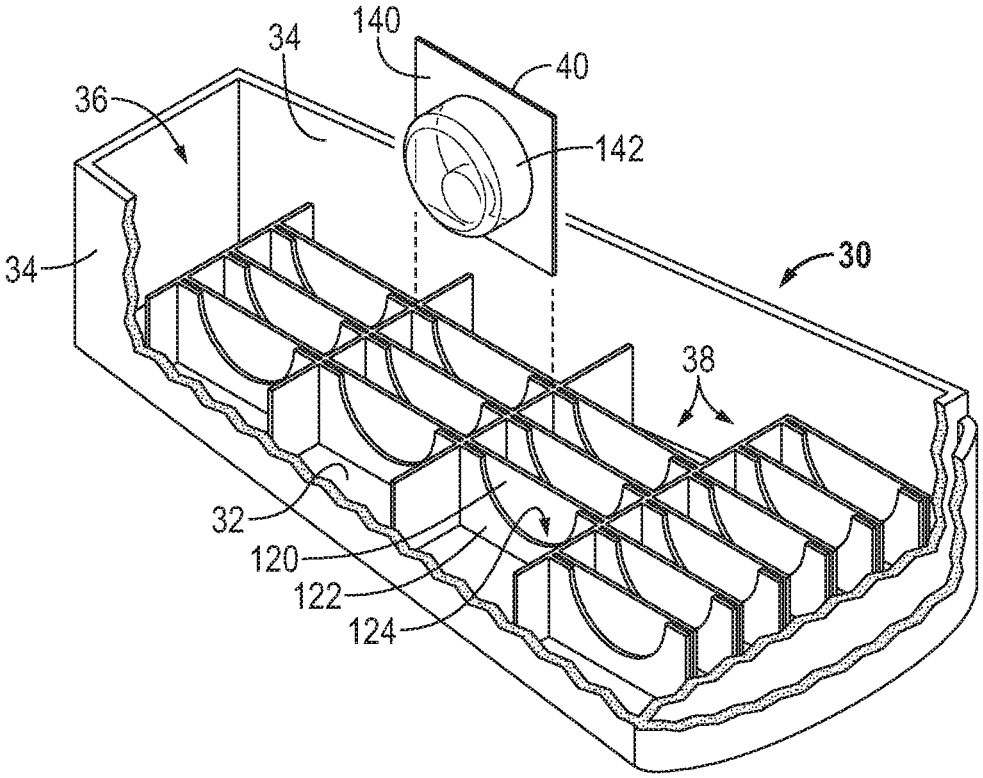
FIG. 8 is a pictorial representation of an embodiment of the invention similar to FIG. 7 but with a different layout.

For clarity, certain details of the invention, for example, wiring and a full complement of trays and medication doses, have been omitted from the drawings.

One embodiment of the invention provides an apparatus 10 useful for securely storing and dispensing medications. The apparatus comprises a cabinet 12, a carousel 20 mounted in the cabinet, and medication trays 30 carried by the carousel. The cabinet has top, bottom and lateral walls 14 carried on a frame 16. One of the lateral walls defines a vertical slot 18. The carousel is mounted on the frame in the cabinet for rotation about a vertical axis 22. The carousel comprises a plurality of vertically spaced shelves 24. Each shelf carries a plurality of radially extending dividers 26 dividing the carousel into a plurality of compartments 28. The compartments are carried by the carousel into close alignment with the vertical slot. The medication trays are positioned in at least a portion of the compartments. Each medication tray is sized and shaped to slide radially in and out of a compartment. Each tray has a base 32 and side walls 34 extending upwardly from the periphery of the base to define a peripherally enclosed area 36 to hold medication doses. Fixtures 38 are mounted in the peripherally enclosed area to vertically position card-blister packaged unit medication doses 40 in multiples of five for visual inventory without manual manipulation of the doses, once a tray is removed from a compartment.

Preferably, the apparatus comprises means for defining an access port 42 mounted for movement along the vertical slot. The access port is sized for passage of only a single tray therethrough. In an embodiment that has been tested with good results, the access port is carried by a belt 44 which is preferably mounted between a pair of tracks 46 positioned alongside the vertical slot. The belt comprises a plurality of linked plates 48 extending transversely between the tracks with one of said plates defining the access port.

The apparatus is preferably provided with carousel drive means 50 mounted to the frame for rotating the carousel and belt drive means 52 mounted to the frame for moving the access port. In a preferred embodiment, the carousel drive comprises a motor 108 coupled to the carousel associated with a position sensor 110, and the belt drive means comprises a motor 104 coupled to the belt associated with a position sensor 106.

In the illustrated embodiment, a user input device 54 is operably associated with a computer means 56 for making a medication demand. A computer memory means 58 is associated with the computer means for associating medication tray location information with the medication demand. The computer means accesses the medication tray information and signals the carousel drive means to rotate the medication tray location into alignment with the slot and signals the belt drive means to move the access port into alignment with the medication tray location.

The invention preferably has failsafe features. In one embodiment, an optical scanner 60 is positioned for vertical movement on an axis alongside the carousel. Optical scanner drive means 112 is provided for vertically moving the scanner along the axis. The computer means further signals the carousel drive means to rotate the medication tray location into alignment with the optical scanner axis and the optical scanner drive means to move the optical scanner alongside the medication tray location, prior to signaling the carousel drive means to rotate the medication tray location into alignment with the slot and signaling the belt drive means to move the access port into alignment with the medication tray location. An optical machine-readable code 62 representative of a medication stored in the tray is positioned on an outer peripheral wall of each tray. The optical scanner reads the code and electronically transmits a signal representative of the code to the computer means for comparison with the medication demand. The computer means makes the comparison and in the event of a match signals the carousel drive means to rotate the medication tray location into alignment with the slot and signals the belt drive means to move the access port into alignment with the medication tray location so that the tray can be removed to access the demanded medication.

In one embodiment, the apparatus is further provided with speaker means to announce the identity of the medication in the tray in alignment with the access port.

Any desired user input devices can be coupled to the computer. For example, a touch-screen 64, a keyboard 66, and a hand-held scanner 100 for reading bar codes. The input devices can be used to access lists of patient medications, demand medications from the list, or demand medications by name or bar-code. The input devices can also used to inventory and restock medications, and to request authorizations to dispense controlled substances if telephone or internet access has been provided. When medications are restocked, they can be flagged with location, date of stocking, expiration date, quantities, National Drug Code, Lot No., etc., and multiple locations can be used to store the same type of medication. In such case, the computer can be programed to select the oldest medications first in response to a demand. Inventory and usage can be continuously tracked, PAR levels can be established, and reordering of medications largely automated. The device can be inventoried and restocked periodically by a visiting pharmacist.

One or more drawers 102 can be provided in a lower portion of the cabinet for storage of bulky items, for example, IV fluid bags, for which high security is not needed.

The invention is preferably used with blister-packs, which is generally a card with a blister overlay containing a single dose of medication in capsule or pill form for a specified patient. The blister-pack is bar-code labeled for control purposes.

One embodiment of the invention a medication tray that holds blister-packs in multiples of five to facilitate contents inventory. The medication tray comprises a base 32, side walls 34 extending upwardly from or from near the periphery of the base to define a peripherally enclosed area 36, and fixtures 38 mounted in the peripherally enclosed area to vertically position card-blister packaged unit medication doses 40 in multiples of five for visual inventory without manual manipulation of the doses.

The tray is preferably for use with the above-described carousel. The base can be described as having a big end and a little end and of generally point-bobbed sector shaped or generally isosceles trapezoid shaped, with two equal converging sides of equal length converging at an angle in the range of about 10 degrees to about 20 degrees toward the little end. A side wall positioned at the big end of the base has an inside surface and an outside surface and a machine-readable code 62 is positioned on the outside surface.

Preferably, the fixtures are positioned in groups of five and hold the cards parallel to each other. More preferably, each tray comprises in the range of 2 to 6 groups of fixtures for positioning five card-mounted unit medication doses in each group.

In a preferred embodiment, each fixture of a group comprises a pair parallel walls 120, 122 extending normally from the base and spaced far enough apart to closely receive the card portion 140 of a card-blister packaged unit medication dose. One of the parallel walls has an upwardly facing cut-out 124 to accept the blister portion 142 of the card-blister packaged unit medication dose.

Each group of fixtures preferably comprises a row of five fixtures 126 for vertically positioning five card-blister packaged medication doses in a row, all parallel to each other and spaced sufficiently far apart to accommodate the blister portion of the packaging units. Each tray preferably comprises multiple rows of five fixtures and the multiple rows are separated by dividing walls 128 extending normally from the base and the pairs of walls of the fixtures.

While certain preferred embodiments of the invention have been described herein, the invention is not to be construed as being so limited, except to the extent that such limitations are found in the claims.

What is claimed is:

1. Apparatus comprising a cabinet having top, bottom and lateral walls carried on a frame, said lateral walls defining a vertical slot, a carousel mounted on the frame in said cabinet for rotation about a vertical axis said carousel comprising a plurality of vertically spaced shelves, each shelf carrying a plurality of radially-extending dividers dividing the carousel into a plurality of compartments; said compartments being carried by the carousel into close alignment with the vertical slot; and medication trays positioned in at least a portion of the compartments, each tray sized and shaped to slide radially in and out of a compartment and having a base, side walls extending upwardly from the periphery of the base to define a peripherally enclosed area to hold medication doses, and fixtures mounted in the peripherally enclosed area to vertically position card-blister packaged unit medication doses in multiples of five for visual inventory without manual manipulation of the doses, once a tray is removed from a compartment, wherein each fixture comprises a pair of parallel walls extending normally from the base and spaced far enough apart to closely receive the card portion of a card-blister packaged unit medication dose.

2. Apparatus comprising a cabinet having top, bottom and lateral walls carried on a frame, said lateral walls defining a vertical slot, an access port mounted for movement along the vertical slot, said access port sized for passage of a single tray therethrough, a carousel mounted on the frame in said cabinet for rotation about a vertical axis said carousel comprising a plurality of vertically spaced shelves, each shelf carrying a plurality of radially-extending dividers dividing the carousel into a plurality of compartments; said compartments being carried by the carousel into close alignment with the vertical slot; and medication trays positioned in at least a portion of the compartments, each tray sized and shaped to slide radially in and out of a compartment and having a base, side walls extending upwardly from the periphery of the base to define a peripherally enclosed area to hold medication doses, and fixtures mounted in the peripherally enclosed area to vertically position card-blister packaged unit medication doses in multiples of five for visual inventory without manual manipulation of the doses, once a tray is removed from a compartment.

3. Apparatus as in claim 2 wherein the access port is carried by a belt.

4. Apparatus as in claim 3 further comprising a pair of tracks positioned alongside the vertical slot, wherein the belt is mounted between the tracks for vertical movement.

5. Apparatus as in claim 4 wherein the belt comprises a plurality of linked plates extending transversely between the tracks, one of said plates defining the access port.

6. Apparatus as in claim 5 further comprising carousel drive means mounted to the frame for rotating the carousel; and belt drive means mounted to the frame for moving the access port.

7. Apparatus as in claim 6 further comprising a user input device operably associated with the computer means for making a medication demand;

computer memory means associated with the computer means for associating medication tray location information with the medication demand; and computer means for accessing the medication tray information and signaling the carousel drive means to rotate the medication tray location into alignment with the slot and for signaling the belt drive means to move the access port into alignment with the medication tray location.

8. Apparatus as in claim 6 further comprising an optical scanner positioned for vertical movement on an axis alongside the carousel, and optical scanner drive means for vertically moving the scanner along the axis, wherein the computer means further signals the carousel drive means to rotate the medication tray location into alignment with the optical scanner axis and the optical scanner drive means to move the optical scanner alongside the medication tray location, prior to signaling the carousel drive means to rotate the medication tray location into alignment with the slot and signaling the belt drive means to move the access port into alignment with the medication tray location.

9. Apparatus as in claim 8 further comprising an optical machine-readable code representative of a medication stored in the tray positioned on an outer peripheral wall of the tray, wherein the optical scanner reads the code and electronically transmits a signal representative of the code to the computer means for comparison with the medication demand, and the computer means makes the comparison and in the event of a match signals the carousel drive means to rotate the medication tray location into alignment with the slot and signals the belt drive means to move the access port into alignment with the medication tray location.

10. Apparatus as in claim 9 further comprising means to announce the identity of the medication in the tray in alignment with the access port.

11. Apparatus as in claim 7 wherein the user input device is a keyboard.

12. A medication tray comprising a base, side walls extending upwardly from the periphery of the base to define a peripherally enclosed area, and fixtures mounted in the peripherally enclosed area to vertically position card-blister packaged unit medication doses in multiples of five for visual inventory without manual manipulation of the doses, wherein each fixture comprises a pair of parallel walls extending normally from the base and spaced far enough apart to closely receive the card portion of a card-blister packaged unit medication dose.

13. A medication tray as in claim 12 wherein the base has a big end and a little end and is generally point-bobbed sector shaped or a generally isosceles trapezoid shaped, with two equal converging sides of equal length converging at an angle in the range of about 10 degrees to about 20 degrees toward the little end.

14. A medication tray as in claim 13 wherein a side wall positioned at the big end of the base has an inside surface and an outside surface and a machine-readable code positioned on the outside surface.

15. A medication tray as in claim 14 wherein the fixtures are positioned in groups of five.

16. A medication tray as in claim 15 comprising in the range of 2 to 6 groups of fixtures for positioning five card-mounted unit medication doses in each group.

17. A medication tray comprising a base, side walls extending upwardly from the periphery of the base to define a peripherally enclosed area, and fixtures mounted in the peripherally enclosed area to vertically position card-blister packaged unit medication doses in multiples of five for visual inventory without manual manipulation of the doses, wherein the base has a big end and a little end and is generally point-bobbed sector shaped or a generally isosceles trapezoid shaped, with two equal converging sides of equal length converging at an angle in the range of about 10 degrees to about 20 degrees toward the little end, wherein a side wall positioned at the big end of the base has an inside surface and an outside surface and a machine-readable code positioned on the outside surface, wherein the fixtures are positioned in the range of 2 to 6 groups of fixtures for positioning five card-mounted unit medication doses in each group, wherein each fixture of a group comprises a pair of parallel walls extending normally from the base and spaced far enough apart to closely receive the card portion of a card-blister packaged unit medication dose, one of said parallel walls having an upwardly facing cut-out to accept the blister portion of the card-blister packaged unit medication dose.

18. A medication tray as in claim 17 wherein each group of fixtures comprises a row of five fixtures for vertically positioning five card-blister packaged medication doses in a row, all parallel to each other and spaced sufficiently far apart to accommodate the blister portion of the packaging units.

19. A medication tray as in claim 18 comprising multiple rows of five fixtures, said multiple rows being separated by dividing walls extending normally from the base and the pairs of walls of the fixtures.

20. Apparatus comprising:

a cabinet having top, bottom and lateral walls carried on a frame, said lateral walls defining a vertical slot, a carousel mounted on the frame in said cabinet for rotation about a vertical axis said carousel comprising a plurality of vertically spaced shelves, each shelf carrying a plurality of radially-extending dividers dividing the carousel into a plurality of compartments; said compartments being carried by the carousel into close alignment with the vertical slot;

an access port mounted for movement along the vertical slot;

wherein the access port is carried by a belt;

a carousel driver mounted to the frame for rotating the carousel;

a belt driver mounted to the frame for moving the access port;

a user input device operably associated with the computer means for making a medication demand;

a computer for signaling the carousel driver to rotate the associated carousel compartment into alignment with the slot and for signaling the belt driver to move the access port into alignment with the associated compartment;

a computer memory associated with the computer for associating carousel compartment location information with the medication demand; and an optical scanner positioned for vertical movement on an axis alongside the carousel, and an optical scanner driver for vertically moving the scanner along the axis, wherein the computer further signals the carousel driver to rotate the associated compartment into alignment with the optical scanner axis and the optical scanner driver to move the optical scanner alongside the associated compartment, prior to signaling the carousel driver to rotate the associated compartment into alignment with the slot and signaling the belt driver to move the access port into alignment with the associated compartment.

* * * * *